US007849840B2

(12) United States Patent
St. James

(10) Patent No.: US 7,849,840 B2
(45) Date of Patent: Dec. 14, 2010

(54) ELECTRIC MOTOR ASSISTED MECHANICAL SUPERCHARGING SYSTEM

(76) Inventor: David St. James, 3395 S. Jones Blvd., #169, Las Vegas, NV (US) 89146

( * ) Notice: Subject to any disclaimer, the term of this patent is extended or adjusted under 35 U.S.C. 154(b) by 260 days.

(21) Appl. No.: 12/077,808

(22) Filed: Mar. 21, 2008

(65) Prior Publication Data

US 2008/0173017 A1 Jul. 24, 2008

Related U.S. Application Data

(63) Continuation-in-part of application No. 11/349,768, filed on Feb. 7, 2006, now abandoned.

(60) Provisional application No. 60/652,264, filed on Feb. 14, 2005.

(51) Int. Cl.
*F02B 47/08* (2006.01)

(52) U.S. Cl. ..... 123/559.3; 123/559.1

(58) Field of Classification Search ..... 60/602, 60/606–609; 123/559.1, 559.3
See application file for complete search history.

(56) References Cited

U.S. PATENT DOCUMENTS 4,078,387 A * 3/1978 Melchior et al. ..... 60/606
4,838,234 A * 6/1989 Mayer ..... 123/559.2
4,927,333 A * 5/1990 Kato ..... 123/561
2004/0050065 A1* 3/2004 Voinov ..... 60/772

FOREIGN PATENT DOCUMENTS

DE 19529740 A1 * 2/1997
JP 11173154 A * 6/1999

* cited by examiner

*Primary Examiner*—Thomas E Denion
*Assistant Examiner*—Mary A Davis
(74) *Attorney, Agent, or Firm*—Gene W. Arant

(57) ABSTRACT

This apparatus and method introduces to the internal combustion engine, with a centrifugal compressor or positive displacement air supercharger, a high speed electric motor/generator which is drivingly coupled to a drive shaft system for the purpose of acceleration and generation of pressurized air at low engine speeds and incorporation of one-way and/or magnetic clutches to provide maximum power to the engine operation at all times. The motor/generator when not driving the supercharger is putting energy back into the engine battery.

5 Claims, 8 Drawing Sheets

FIG. 3 FOR GASOLINE ENGINES

FOR DIESEL ENGINES

ELECTRIC MOTOR ASSISTED MECHANICAL SUPERCHARGING SYSTEM

CROSS REFERENCE TO RELATED APPLICATION

Priority Claim

This application is a Continuation-in-Part (CIP) of my application Ser. No. 11/349,768, filed Feb. 7, 2006 now abandoned, which also claims priority of my Provisional application, Ser. No. 60/652,264, filed Feb. 14, 2005 and for which I claim priority under Title 35 USC Section 120.

FIELD OF INVENTION

This invention relates generally to optimizing airflow to internal combustion engines to create more power.

BACKGROUND OF THE INVENTION

Applications of superchargers in internal combustion engines, whereby pressurized air is generated by means of a centrifugal compressor or a positive displacement air pump such as a roots blower, have been in practice for many years. The power to operate the supercharger is obtained from the engine itself, usually by means of a belt and pulley arrangement or direct gear drive.

Supercharging enables the engine to generate more power by means of a higher volume of air being fed to the engine under pressure and corresponding adjustment to fuel flow. It is not uncommon to increase engine power by 50% or higher with the aid of a supercharger, proportional to the pressure of boosted air, which is also proportional to the rotational speed of the supercharger. Therefore, the faster the engine turns, the faster the supercharger speed and therefore higher air pressure and more power is generated.

The drawback of conventional supercharging, however, is the fact that many vehicles need maximum power from start through acceleration, such as from stand still at a traffic light. In such instances, the engine is turning at low or no RPM, which in turn is rotating the supercharger at a low or no RPM, resulting in very low or no air pressure. It is not until the engine speed increases that an appreciable increase in power can be realized.

Although generation of power at high engine speeds is beneficial for high vehicle speeds and heavy load carrying applications, the lack of increased power during acceleration is a serious drawback, particularly in applications with a diesel engine when reduced air flow during acceleration usually results in the emission of black smoke.

SUMMARY OF THE INVENTION

The present invention addresses the low air pressure problem during low engine RPM by drivingly coupling an auxiliary electric motor/generator to the drive shaft of the compressor in the supercharging system. The auxiliary electric motor/generator is utilized prior to and during low engine RPM to accelerate the compressor to an optimum RPM so that high pressure air can be utilized for increasing the internal combustion engine's power during starting and acceleration of the vehicle.

As a further feature of the invention the supercharger also has the ability to put energy back into the vehicle's electrical system.

Once the vehicle has attained the desired speed together with high engine RPM, the auxiliary electric motor/generator will be switched off so that the internal combustion engine will then power the compressor such as by means of a belt or gear drive for continuous operation. The functioning of the auxiliary electric motor/generator is controlled by an engine management system or from other circuits.

The electric motor/generator is used to start the compressor as needed, but when the engine power picks up the compressor load, the electric motor/generator is then decoupled as the main power source to the compressor. Later, its electrical circuit connections may be automatically modified under control of an engine management system so that it acts as a generator, delivering power back into the vehicle's electrical system.

A one-way clutch and/or a magnetic clutch placed between the compressor drive shaft and pulley for the belt drive or gear for a gear drive, will disconnect the compressor drive shaft from the engine so that prior to starting the engine the auxiliary electric motor/generator can freely accelerate the compressor to optimum RPM. The electric motor/generator can later be switched off, and the one-way clutch associated with the engine is then engaged so that engine power will thereafter drive the compressor for sustained high power operation.

As another feature of the invention, when the load of the compressor has been picked up by the engine power, the auxiliary electric motor/generator, rather than being taken out of operation, may have its electronic controls switched so that it will then generate electricity to go back into the vehicle's electrical system (i.e., battery).

Under low load conditions, a magnetic clutch may also be used to disconnect the engine from the compressor for the purpose of reducing parasitic drag on the engine, and the drive from the auxiliary electric motor/generator may then also be switched off.

MODES OF OPERATION

There are several separate and distinct modes of operation of the supercharger system shown in drawing FIG. 1.

In one mode of operation the electric motor/generator is used to raise air pressure in the cylinders before the engine is started. Once the engine is started, and after it picks up sufficient speed, it acts through a clutching mechanism to pick up the compressor load, and the electric motor/generator will then have its drive train decoupled from the compressor, and the motor/generator may then be made to be inactive.

In another mode of operation the electric motor/generator is used to boost the air pressure in the cylinders, whether the internal combustion engine is not yet started or is already running, but at low RPM.

In a further mode of operation the electric motor/generator is used to raise air pressure both before and during, or after, the starting of the engine. After the engine has been started and has picked up the compressor load from the electric motor/generator, the circuit connections for the motor/generator are automatically modified under control of the engine management system so that it becomes a generator and feeds power back into the vehicle's electrical system.

In still another mode of operation neither the electric motor/generator nor the mechanical drive from the engine have been used to drive the compressor because the engine operator has not had a need to utilize the supercharging capability of the compressor. This would also be the case when the supercharger is used on a turbo-charged engine and the turbo is providing more air than what the compressor is capable of delivering such as at higher engine RPM.

In still a further mode of operation the compressor is driven by the engine only, and the electric motor/generator is used only to feed power back to the engine's electrical system.

BRIEF DESCRIPTION OF DRAWINGS

Drawing Summary

GENERAL PARTS LIST

Figure 1:
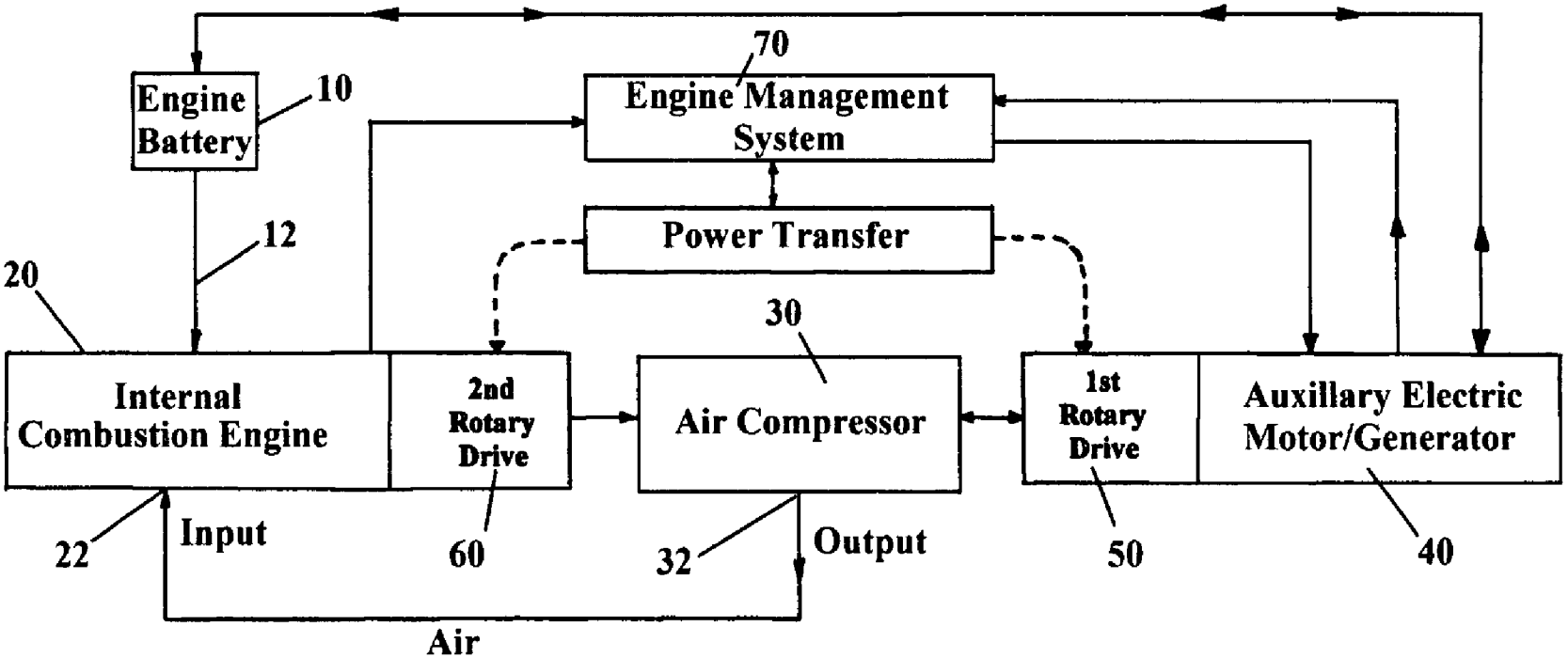
FIG. 1 is a schematic drawing of the supercharger system of the present invention showing first and second rotary drive power units which may be selectively drivingly coupled to the air compressor for transferring the rotary power load back and forth between the engine and electric motor/generator as needed.

10 Engine Battery
12 energy line from battery to engine
20 Internal Combustion Engine
22 air input of engine
24 engine crankshaft
26 pulley wheel
27 driving belt
28 one-way clutch
30 Air Compressor
32 air output from compressor to engine
34 by-pass valve
36 Supercharger housing
40 Auxiliary Electric Motor/Generator (EMG)
42 Stator
44 Rotor
50 First Rotary Drive Means to compressor shaft
52 magnetic clutch associated with first rotary drive
54 Rotatably supported end of shaft 50
60 Second Rotary Drive Means to compressor shaft
62 magnetic clutch associated with second rotary drive
70 Engine Management System (EMS)

DETAILED DESCRIPTION OF THE INVENTION

In the Preferred Embodiment

DETAILED DESCRIPTION OF THE APPARATUS

Referring now to the schematic system drawing of FIG. 1, certain parts of the apparatus are shown in separate boxes, some parts are schematically illustrated only by a solid line, and an important operating function is indicated only by dotted lines.

An Engine Management System (70) is connected to other parts of the apparatus system by various communication and control lines as needed, some of which are shown, without reference numbers in the FIG. 1 drawing. A Power Transfer function, indicated by dotted lines and controlled by the engine management system, provides the capability of transferring control of rotary power for the air compressor between a first and a second rotary drive means.

One main function of the engine management system (70) is to make it possible to use the Auxiliary Electric Motor/Generator (40), through its first rotary drive means (50), to drive the Compressor (30) before or after starting the Engine (20). The operator will activate the engine management system to initiate this operation when it is desired to start the engine.

The First Rotary Drive Means (50) couples the motor/generator (40) to the Compressor (30). The First Rotary Drive Means has a shaft with only one direction of rotation, which is selectively operable for delivering rotary power from the motor/generator (40) to the compressor (30). This shaft will also have the ability to transfer rotary power from the second rotary drive means to both the motor/generator (40) and the compressor (30). The Motor/generator (40) will typically be of the switched-reluctance type.

Before starting the engine, the compressor (30) is started by energizing the motor/generator (40). At some appropriate time, and typically when an appropriate level of rotation speed of the engine crankshaft has been achieved, the engine (20) will then be started. This can be done by the engine's normal starter motor, not shown in the drawings, which may be of conventional construction. The starting action will normally be achieved by a signal sent from the EMS (70) to the engine's normal starter motor.

The starting of the engine may also be done at some fixed time interval after the Electric Motor/Generator (40) has been started; or it may be done at discretion of the operator.

After the engine has been started there are two separate drives to the compressor (30) that might potentially operate in parallel. The engine output power is coupled to the compressor (30) through a Second Rotary Drive Means (60), which may for example, include a one-way or overrunning mechanical clutch (28) and or a magnetic clutch (62). A finite amount of time is required for the engine shaft speed to reach a level sufficient to overtake the drive from the motor/generator (40). First Rotary Drive Means (50) contains externally controlled clutch means to allow the motor/generator drive to remain in control until overtaken by the engine drive. For example, the drive means (50) may include a magnetic clutch (52) (See FIG. 2) whose operation is controlled by signals from the engine management system (70).

When a power transfer is to take place, the drive from the motor/generator (40) through first drive means (50) to the compressor is then replaced by rotary driving power the from engine (20) through second rotary drive means (60). Control of that transition is an important function of the engine management system (70). It would not be at all acceptable from a mechanical point of view to allow the two separate drives through the parallel paths to be in effect concurrently. There may be a short time gap after the release of drive means (50) before the engagement by drive means (60). A tolerable figure for that time gap might be a fraction of a second, or one second, or more than one second, depending upon the mechanical characteristics of the system. It may be possible for the engine management system (70) to control the transition rather precisely, so that the engine picks up the compressor load concurrently with release from drive by the motor/generator (40).

In any event, the engine management system (70) may be designed to accomplish this transition in a satisfactory manner. In order to monitor the successful accomplishment of the transition, it is advisable, and perhaps necessary, for the EMS to receive real-time information on the rotary drive speeds of both the output shaft of the motor/generator (40) and the output shaft of the engine (20).

Alternatively, a provision may be made for the operator to monitor the transition, and perhaps intercede in this control function of the engine management system.

The function of the engine management system (70) in transferring control of input power to the compressor (30) has now been described. Another very important feature of the apparatus system of the present invention is that when an appropriate engine speed has been achieved, engine power may then be used to send energy through the compressor (30) and the motor/generator (40) back to the battery (10) to recharge the battery. In order to accomplish that, it is necessary for the electrical character of electric motor/generator (40) to be reversed from motor operation to generator operation. It is essential that the motor/generator (40) be of a type in which its operation can be switched electrically from motor action to generator action without reversing the direction of rotation of its output shaft. Such a motor/generator may, for example, be of the variable reluctance type, and more specifically of the switched reluctance type. To accomplish that transition an appropriate control signal is sent from the engine management system (70) to the internal electrical system of the motor/generator (40).

Figure 2:
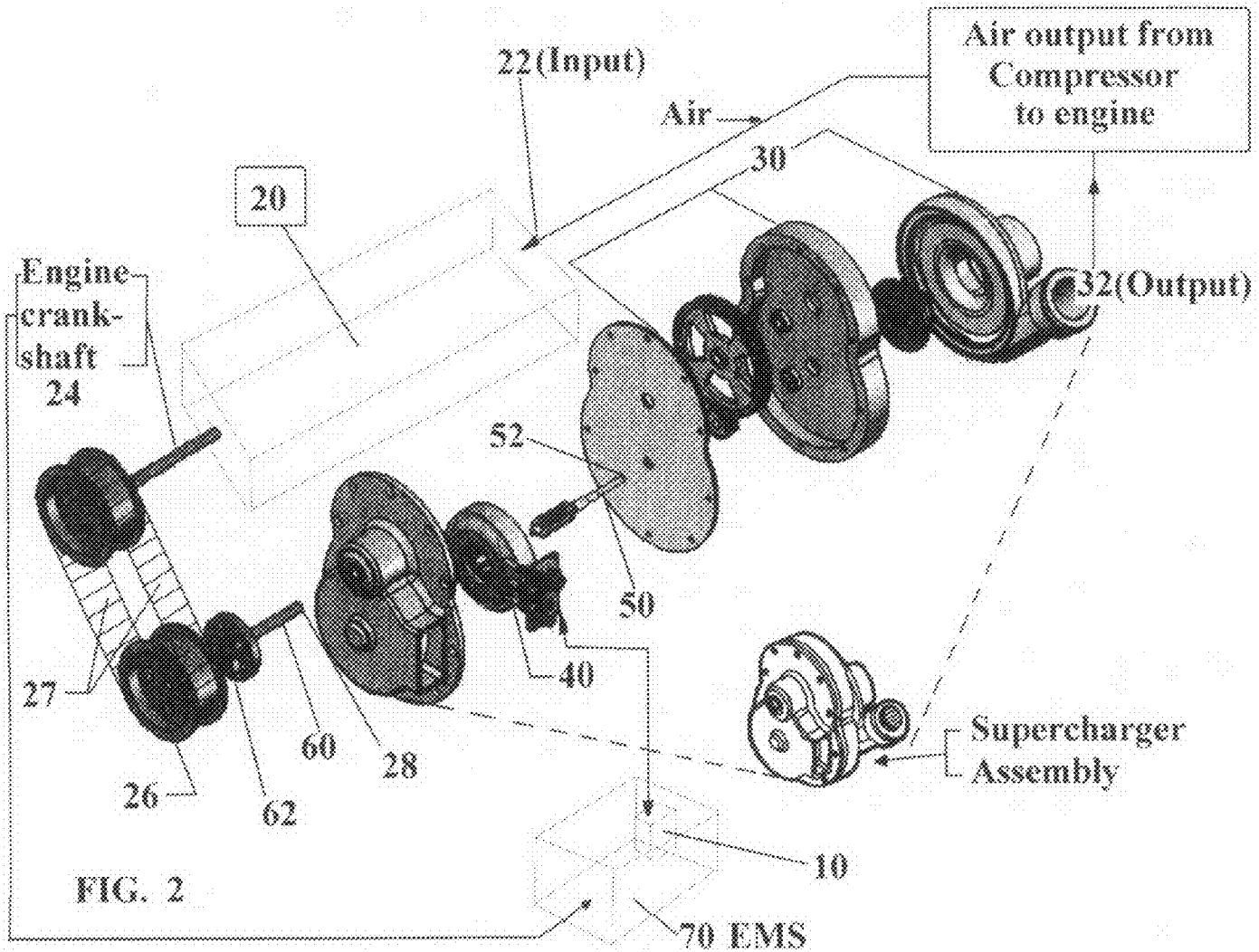
FIG. 2 is a break-away perspective view of one form of apparatus of the supercharging system of the invention showing its major parts.

In FIG. 2 the invention is illustrated in the context of an internal combustion engine having a vehicle engine management system (70) and an air intake (22) for the engine, which receives pressurized air from the output (32) of the compressor. A Supercharger assembly as shown in FIG. 2 has a housing (36) that encloses a compressor (30), supported on a compressor drive shaft that is part of the first rotary drive means (50).

In accordance with standard engine practice, there is a rotating drive mechanism which delivers rotary power from the engine output shaft to the compressor assembly. The rotating drive may include a pulley wheel (26) and driving belt (27) or other rotary power transfer which is powered by the engine's crankshaft (24).

An Electric motor/generator (40) is directly connected through drive means (50) to the Compressor (30) within the supercharger assembly. When the Electric motor/generator is started with a switch by the operator, it then drives the compressor (30) to provide pressurized air to the engine.

After the operator starts the engine (20) the compressor will be powered by the second Rotary Drive Means (60). This rotating drive mechanism includes a pulley wheel (26) driven by a belt or other means of rotary drive (27) which is powered directly from the engine's crankshaft (24). In a Diesel Engine there is a slightly longer wait time than in a Gas Engine to start the engine due to the fact that usually the glow plugs must heat up before the operator starts the engine.

When the engine RPM (second Rotary Drive Means) exceeds the RPM of the electric motor/generator, the motor will be deactivated, allowing its shaft (50) to spin freely, or the motor can be enabled to act as generator as dictated by the EMS (70) or other circuits. At any time thereafter, the Electric motor/generator may return power to the vehicle's battery (10). The amount of power from the Electric motor/generator can be varied as controlled by the EMS depending on the charging needs.

A magnetic clutch (62) may be placed at a desired location in the rotating drive mechanism (60) for the purpose of selectively turning on the compressor operation. As is well known, the magnetic clutch can be quickly activated to maintain the driving relationship of the successive portions of the drive mechanism, or may be quickly activated to disengage them. Thus, it becomes an "on off" switch for the compressor controlled by the EMS (70).

The electric motor/generator (40) energized from the vehicle's battery (10) is selectively used under control of the Engine Management System (70) for driving the compressor (30).

Figure 3:
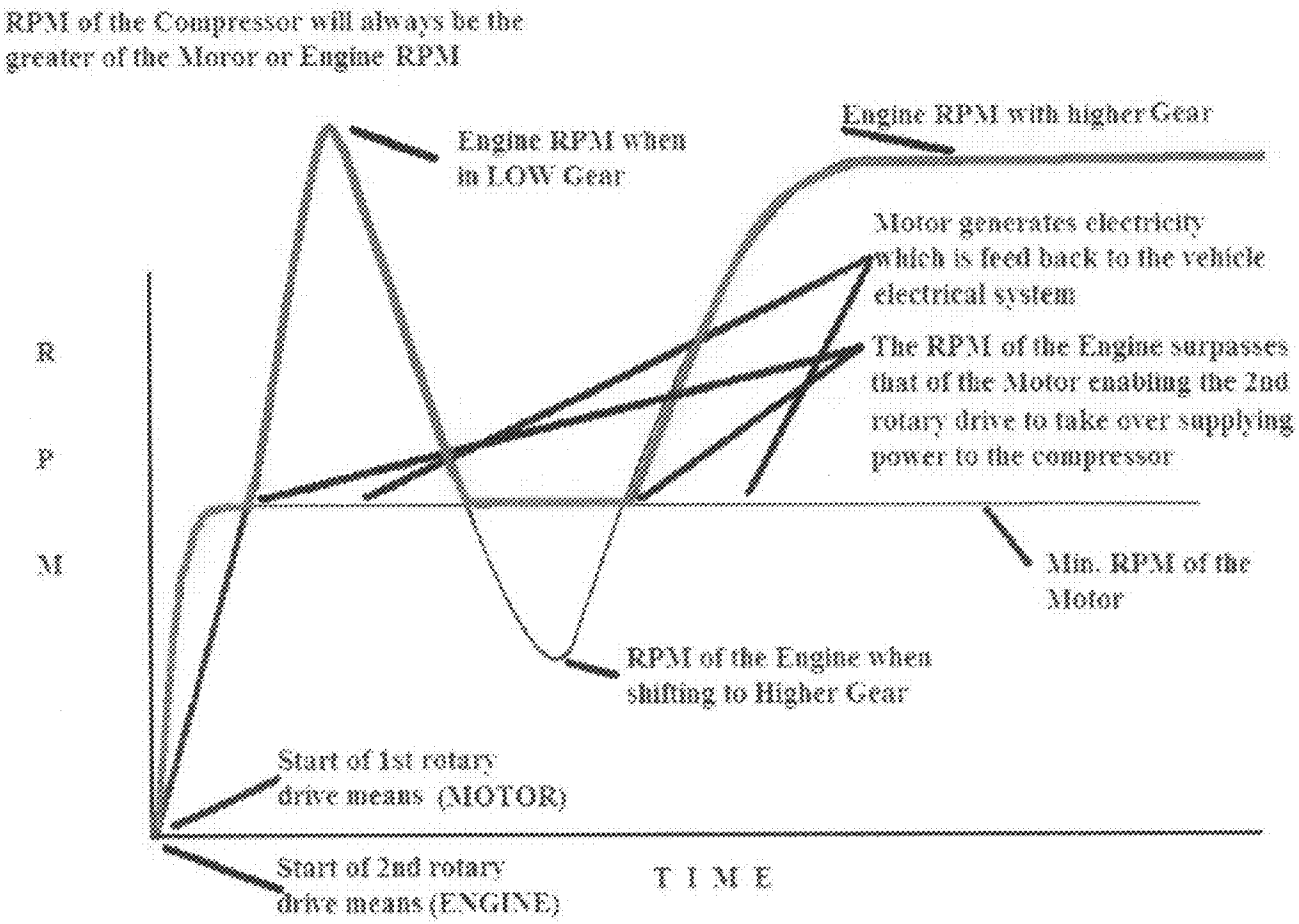
FIG. 3 is a graph of anticipated compressor RPM vs time for a Gasoline Engine, when both the auxiliary electric motor/generator and the engine have been activated from a starting position, and showing optional times for initiating recharging of the battery.
Figure 4:
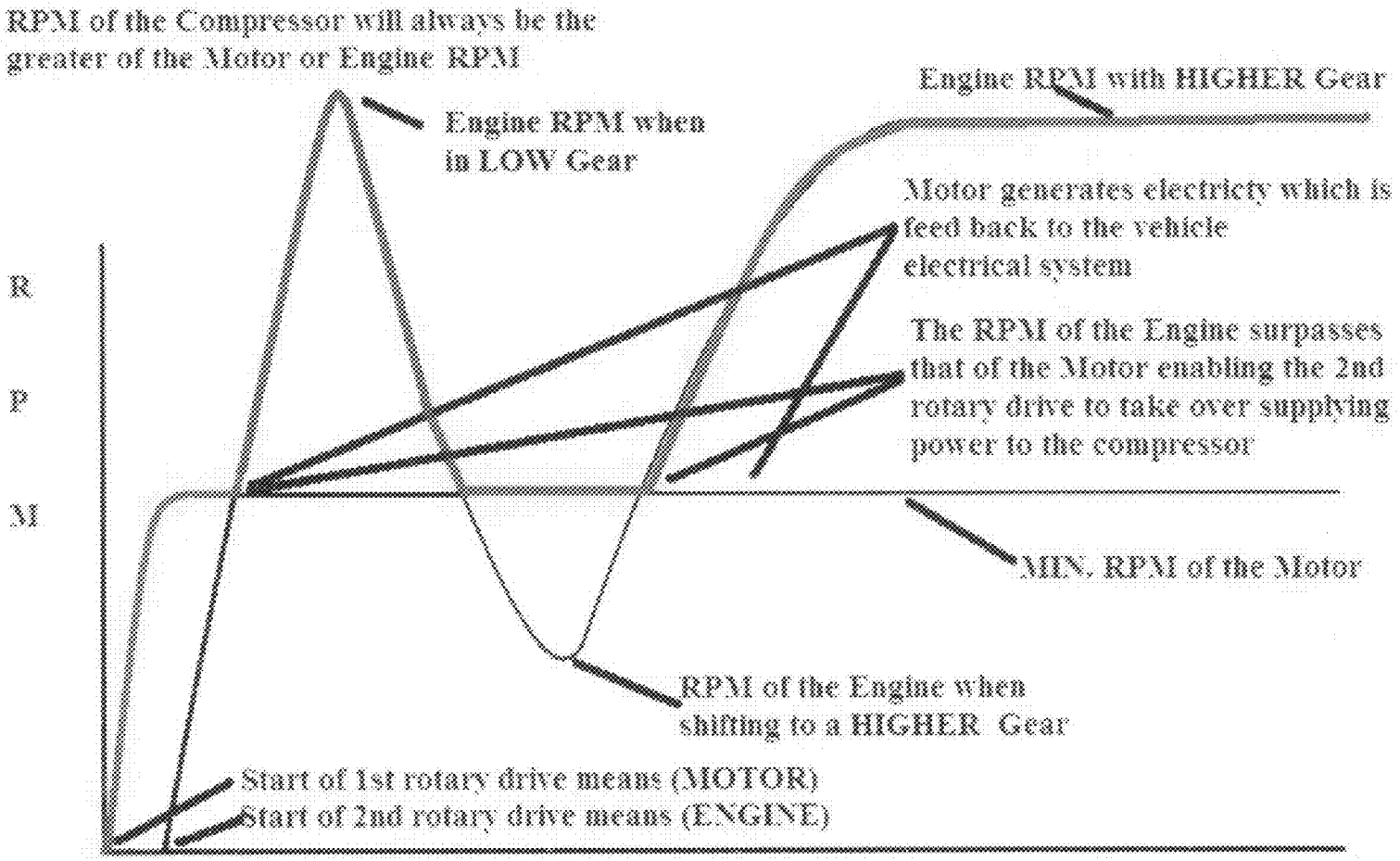
FIG. 4 is a graph of anticipated compressor RPM vs time for a Diesel Engine, when both the engine and the auxiliary electric motor-generator have been activated from a starting position.

One can see in FIG. 3 and FIG. 4 the result of the power vs time anticipated when using the preferred embodiment of the invention. FIG. 3 is a graph of anticipated compressor RPM vs time using a vehicle with a Gasoline Engine, when the engine and auxiliary electric motor/generator have been activated from their starting positions. FIG. 4 is a graph of anticipated compressor RPM vs time for a vehicle with a Diesel Engine, when the engine and auxiliary electric motor/generator have been activated from their starting positions.

Figure 9:
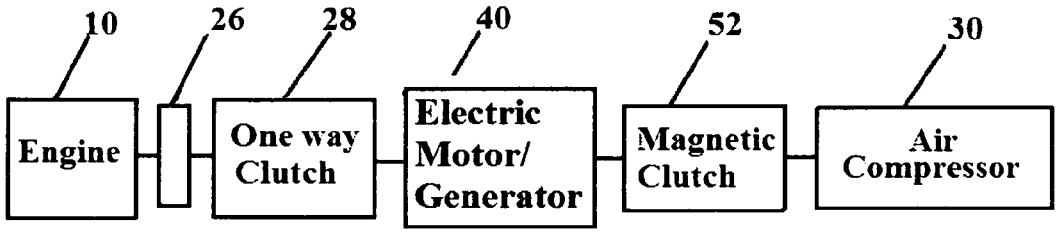
FIG. 9 is a schematic drawing of another form of apparatus system in accordance with the invention.

FIG. 9 illustrates an embodiment for the invention in which the electric motor/generator EMG (40) is located intermediate to engine (10) and compressor (30). The EMG (40) may be started in advance of starting engine (10) and may drive compressor (30) either directly or optionally as shown through magnetic clutch (52). When engine (10) is later started it can drive EMG (40) through a one-way clutch (28) to act as a generator for recharging the battery. The shaft (50) of EMG (40) will still drive the compressor (30) unless the magnetic clutch (52) is deactivated. FIG. 9 is a generalized illustration of the system of apparatus shown in FIG. 2, except that a gear drive and a supercharger housing are not specifically shown.

An important feature of the apparatus in FIG. 2 is that the rotor (44), Shaft (54) and Shaft (50) are an integral mechanical structure by which or from which, all other rotatable parts of the assembly are supported. The generalized description of FIG. 1 does not specifically address that fact.

Figure 5:
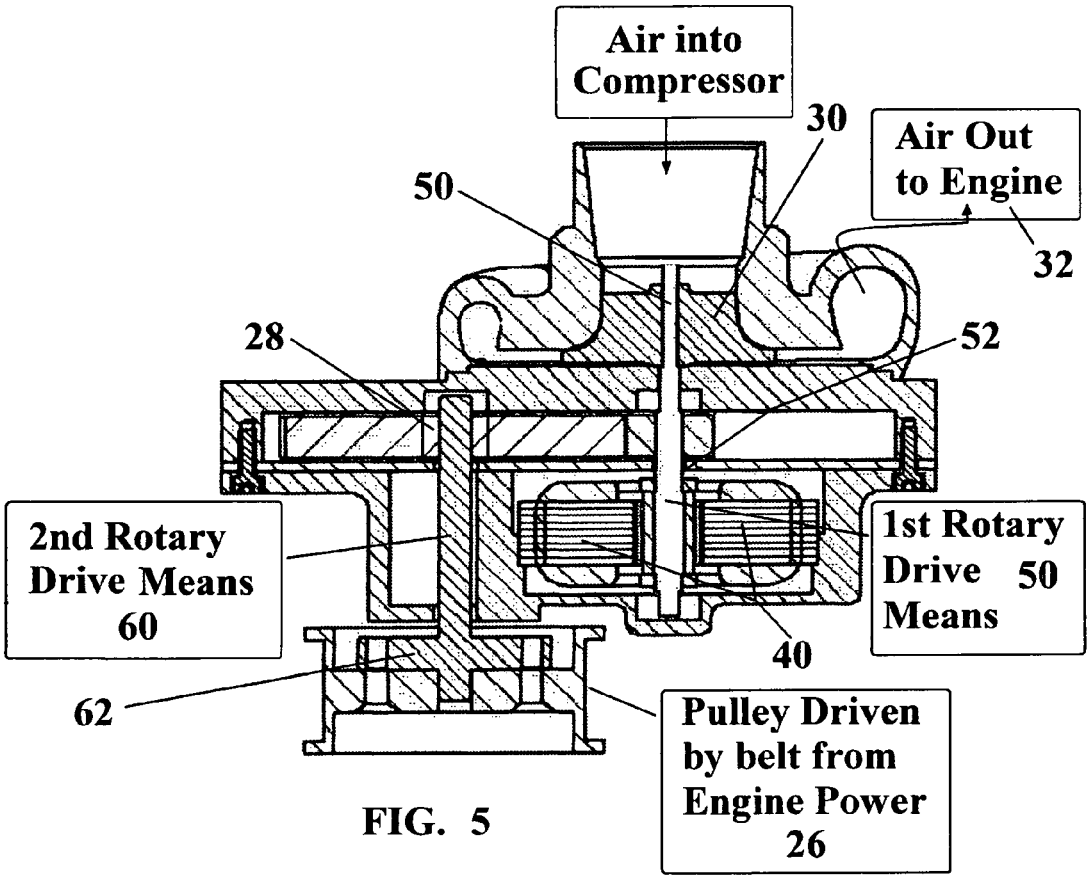
FIG. 5 is a cross-sectional view of the packaging arrangement in accordance with FIG. 2, showing the locations of the electric motor/generator and of the first and second rotary drive means.
Figure 6:
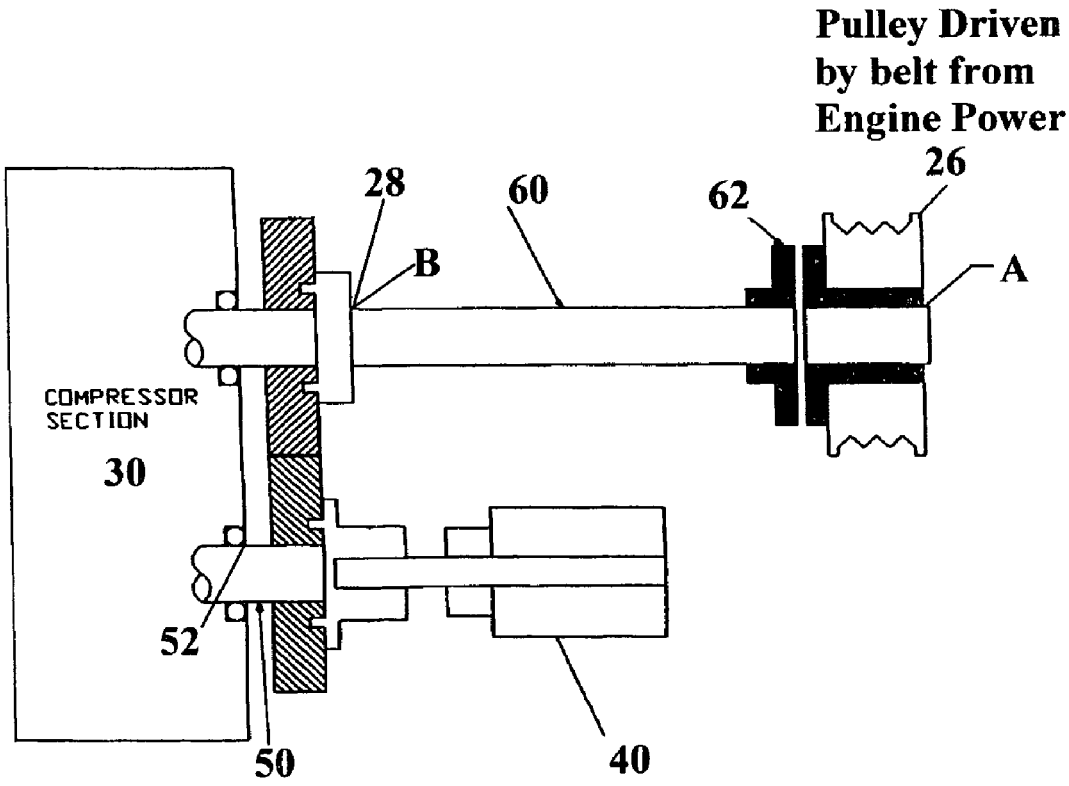
FIG. 6 is a cross-sectional view of modified apparatus in accordance with the present invention, showing a Roots type positive displacement compressor, a drive pulley from the engine output shaft to the compressor input, an electric motor/generator drivingly coupled to the compressor input through a magnetic clutch, and some possible one-way clutch locations.

The presently preferred form of apparatus of the invention is shown FIGS. 2, 5, and 9, The engine crank-shaft (24) rotates in only one direction. The rotor (44) and shaft (50) of the EMG rotate in only one direction, which is the same as the direction of rotation of the drive from the engine shaft (24). The use of one or more clutches in the system of apparatus results in additional shaft segment which, however, rotate only in the very same direction.

A one-way clutch (28) is preferably located between the EMG (40), and the second rotary drive mechanism (60). The purpose of the one-way clutch (28), which may be a typical mechanical over-running clutch, is to permit the output power from the electric motor/generator to pick up the compressor load by driving the compressor faster than it is being driven by the engine.

It is possible to locate a magnetic clutch (60) adjacent to the one way clutch (28). The purpose of this magnetic clutch is to allow the operator or the EMS (70) to completely disconnect the supercharger from the second rotary drive (60) by de-activating the magnetic clutch (62).

In the preferred embodiment an electric motor/generator (40) without any permanent magnets in its construction such as an induction motor and preferably a switched reluctance motor is incorporated. Magnets are generally sensitive to heat, and in the hot engine environment there is always the danger of the magnets becoming demagnetized due to heat.

Furthermore, the rotor assemblies of permanent magnet motors are prone to failure at high speed. Incorporation of rotors with permanent magnets may also require additional one way clutching for operational modes when the electric motor/generator (40) is switched off but the compressor is turning under power from the engine, whereby rotation of a rotor with magnets with the motor off mode can generate excessive heat and cause electromagnetic losses. Therefore, a reluctance motor/generator (40) which generates maximum torque during acceleration, and has no permanent magnets in its construction, is the preferred choice for this invention.

In a preferred embodiment the electric motor/generator (40) is a variable reluctance type, and more specifically, switched-reluctance.

In applications with two stroke engines whereby pressurized air is helpful for the starting of an engine, the electric motor/generator is activated upon turning the ignition to the on position prior to cranking the engine. This starting mode is also applicable to cold starting of a diesel engine, whereby in cold weather conditions warm intake air is also helpful. The benefit of this feature is that by activating the motor and through the process of pressurization, the temperature of the air in the cylinders will increase and thereby facilitate easier starting of the engine.

In other operational modes, the engine is started with the electric motor/generator in the off position. Once the gear is engaged and the accelerator pedal is depressed, the electric motor/generator receives a signal from the engine management system (70) and is energized, speeding up the compressor and thus supplying the engine with pressurized air for the initial rapid acceleration. During this mode, a one-way clutch could enable the electric motor/generator to accelerate to its maximum speed, without having to rotate the pulley and belt arrangement. As the engine speed builds up and the engine speed multiplied by the belt and pulley speed multiplication and gear drives can take over rotation of the compressor wheel, the electric motor/generator (40) is switched off, so that the engine alone can continue to drive the compressor.

The engine management system (70) can be programmed to disengage the supercharger during low engine power demand periods such as high speed cruising in order to reduce parasitic drag from the supercharger on the engine.

By programming the engine management system (70), the electric motor/generator (40) can be re-energized at any time that demand for more power is made and the engine is turning at a low RPM so that the cycle can be repeated. If demand for power is made and the engine speed is high enough for generation of sufficient boost, then the engine management system can by-pass activation of the electric motor and allow the engine to drive the compressor.

The unit may also incorporate an integral passive by-pass valve (34). The by-pass valve will allow unrestricted air flow to the engine while the compressor is not in operation. This feature will eliminate any restriction of air flow through the compressor wheel when the unit is off. The integral valve (34) as shown in FIG. 7, is a hinged piece of metal or plastic which is placed between the air intake passage and the compressor wheel collector.

Figure 7:
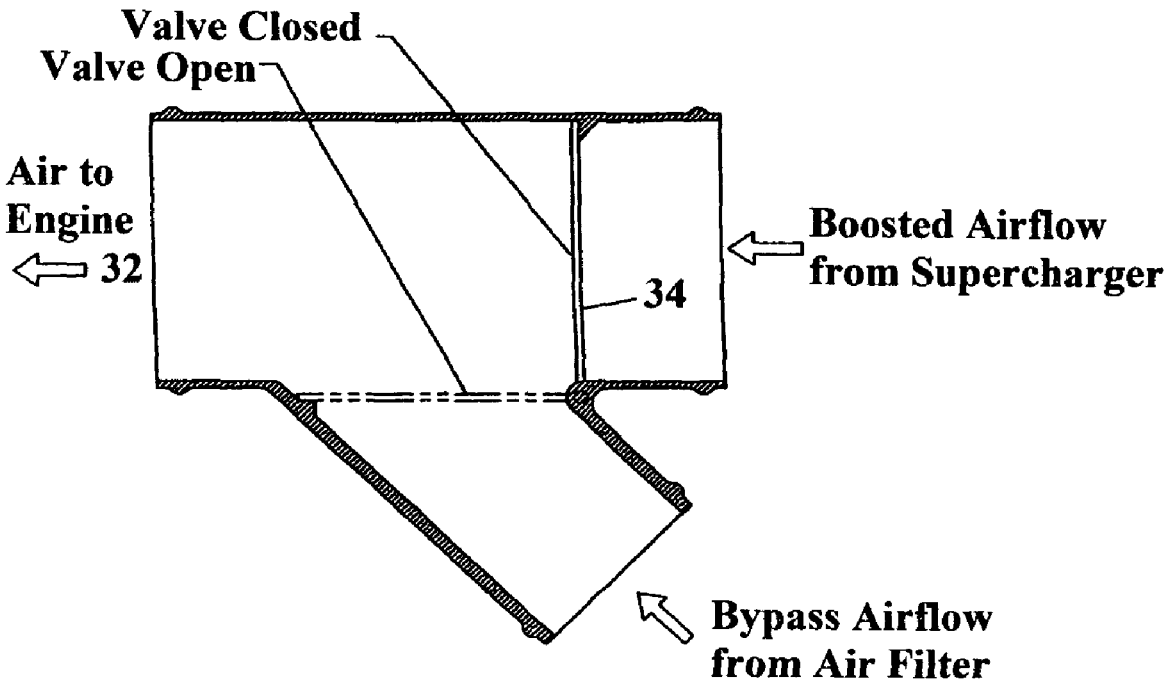
FIG. 7 is a schematic drawing of an air intake system incorporating an independent air by-pass flapper valve for controlling the air flow in an electric motor/generator assisted supercharger system.
Figure 8:
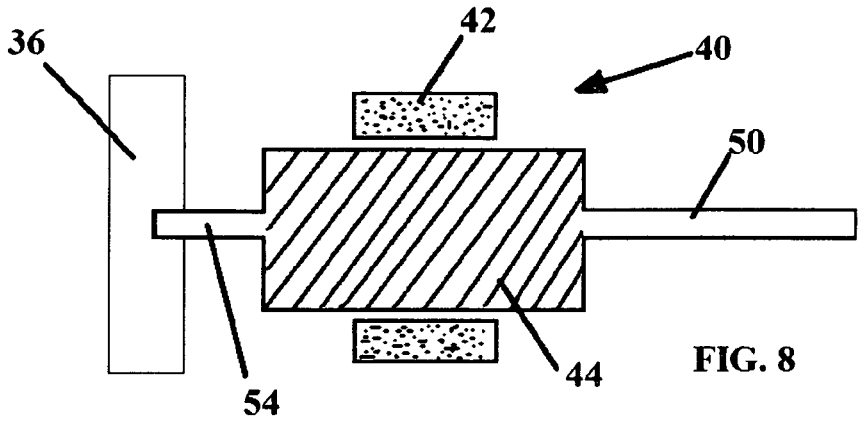
FIG. 8 is a view illustrating more clearly the mechanical configuration of the electric motor/generator of FIG. 2; the stator and rotor being shown in cross section.

In an application such as a turbo-charged engine, an external by-pass valve as shown in FIG. 7 can be incorporated in the engine air intake system so that unrestricted air can enter the engine when the compressor is off, or when the engine is drawing more air at higher speeds than the compressor can provide.

A preferred embodiment of my invention has been described in detail to comply with requirements of the patent law. It will be understood however, that the scope of the invention is determined only by the following claims.

What I claim is:

1. An internal combustion engine system comprising, in combination:

an engine having a combustion air intake and an output shaft;

a battery to provide power for starting the engine;

a compressor having an output for selectively supplying air at above atmospheric pressure to the engine air intake;

an electric motor/generator of the switched-reluctance, which is adapted to be energized from the battery;

first rotary drive means rotatably drivingly coupling the electric motor/generator to the compressor, the first rotary drive means driving the compressor at a speed significantly higher than the speed that is imparted by the engine when the engine is first started;

second rotary drive means including both an overrunning clutch and a magnetic clutch operating in series, selectively drivingly coupling the output shaft of the engine to the compressor; and an engine management system operable whenever the engine acquires sufficient speed to override the drive applied from the electric motor/generator through the first rotary drive means to the compressor to selectively transfer the rotating drive energy received by the compressor from the first rotary drive means to the second rotary drive means.

2. The apparatus as claimed in claim 1 wherein a supercharger assembly housing contains both the first and second rotary drive means and the electric motor/generator.

3. The apparatus of claim 1 wherein the first drive means also includes a magnetic clutch.

4. The internal combustion engine system of claim 1 which further include a turbo charger, and an external by-pass valve for routing intake air around the compressor to the engine at higher engine speeds.

5. In an engine system including an engine, a battery for starting the engine, an air compressor for providing extra input air to the engine, and an engine management system, the method for providing increased engine volumetric efficiency, comprising the steps of:

selecting an auxiliary electric motor/generator of the switched-reluctance and coupling it to the battery for electrical transmission of energy therebetween; coupling the motor/generator to the air compressor through a first rotary drive that is adapted to transmit power in either direction;

utilizing the engine battery to start the motor/generator before starting the internal combustion engine;

thereafter when the internal combustion engine has started, drivingly coupling it through a second rotary drive means to the air compressor;

where the second rotary drive means includes both an overrunning clutch and a magnetic clutch operating in series;

decoupling the motor/generator from the first rotary drive means when the rotary drive speed to the second rotary drive means exceeds that of the first rotary drive means so that the internal combustion engine will then provide power through the second rotary drive means to the air compressor; and thereafter, when the engine reaches a pre-determined speed, utilizing the engine management system to change the motor/generator's electrical characteristics to operate as a generator and again couple the compressor through the first rotary drive means to the motor/generator so that a portion of the engine's power then produces energy for recharging the battery.

* * * * *